US007836733B2

(12) United States Patent
Bae et al.

(10) Patent No.: US 7,836,733 B2
(45) Date of Patent: Nov. 23, 2010

(54) LAUNDRY MACHINE AND LINT FILTER THEREOF

(75) Inventors: Jong Deuk Bae, Changwon-si (KR); Jong Gil Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 651 days.

(21) Appl. No.: 11/587,477

(22) PCT Filed: May 25, 2005

(86) PCT No.: PCT/KR2005/001536

§ 371 (c)(1),
(2), (4) Date: Dec. 10, 2007

(87) PCT Pub. No.: WO2005/118940

PCT Pub. Date: Dec. 15, 2005

(65) Prior Publication Data

US 2008/0196452 A1 Aug. 21, 2008

(30) Foreign Application Priority Data

Jun. 1, 2004 (KR) ..... 10-2004-0039493
Jun. 1, 2004 (KR) ..... 10-2004-0039494

(51) Int. Cl.
*D06F 39/10* (2006.01)

(52) U.S. Cl. ..... 68/18 F; 134/111

(58) Field of Classification Search ..... 68/18 F; 134/111

See application file for complete search history.

(56) References Cited

U.S. PATENT DOCUMENTS

| | | | | | |
|---|---|---|---|---|---|
| 2,936,604 | A | * | 5/1960 | Glendening | 68/18 F |
| 2,939,305 | A | * | 6/1960 | Snyder et al. | 68/18 F |
| 2,942,444 | A | * | 6/1960 | Abresch | 68/17 A |
| 2,962,886 | A | * | 12/1960 | Johnson | 68/18 F |
| 3,040,552 | A | * | 6/1962 | Platt et al. | 68/18 F |
| 3,240,345 | A | * | 3/1966 | Butler et al | 210/435 |
| 5,849,182 | A | * | 12/1998 | Shin | 210/167.01 |
| 5,989,418 | A | * | 11/1999 | Shin | 210/167.01 |

FOREIGN PATENT DOCUMENTS

| | | | |
|---|---|---|---|
| JP | 54-163575 | | 12/1979 |
| JP | 01-303198 | * | 12/1989 |
| JP | 02-005998 | * | 1/1990 |
| JP | 50-82869 | | 4/1993 |
| JP | 06-031094 | * | 2/1994 |
| JP | 08-323096 | * | 12/1996 |
| JP | 09-299685 | * | 11/1997 |
| JP | 10-000293 | * | 1/1998 |
| JP | 2000-354697 | * | 12/2000 |
| KR | 1999-11133 | | 2/1999 |
| KR | 1999-16477 | | 3/1999 |

OTHER PUBLICATIONS

International Search Report dated Aug. 30, 2005.

* cited by examiner

*Primary Examiner*—Frankie L Stinson
(74) *Attorney, Agent, or Firm*—Ked & Associates LLP

(57) ABSTRACT

A lint filter of a laundry machine is provided. In the lint filter, a case is provided, a front filter is installed in the case and the front filler includes a hook formed at least one side, and a rear filter is mounted on a back of the front filter.

12 Claims, 6 Drawing Sheets

[Fig. 1]
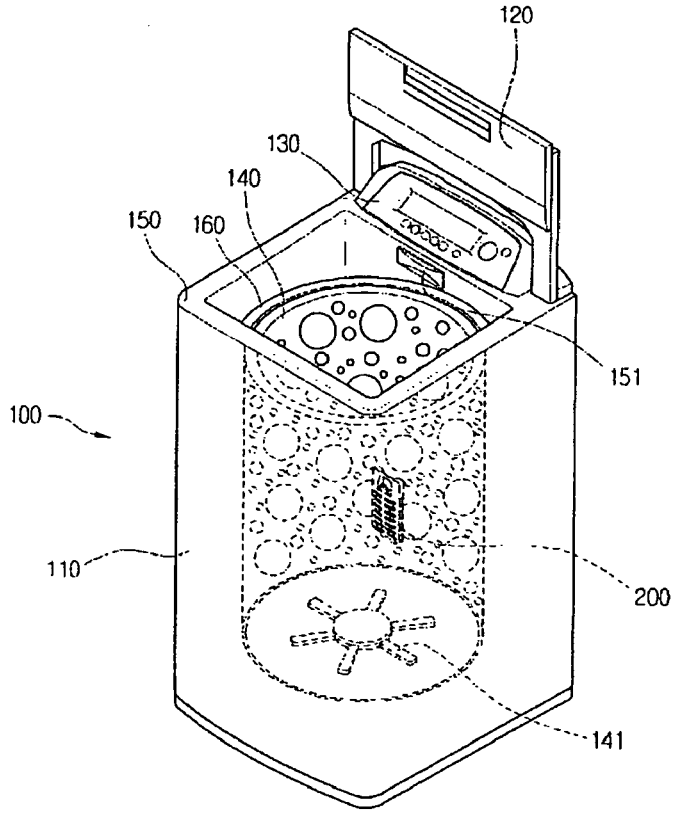
[Fig. 2]
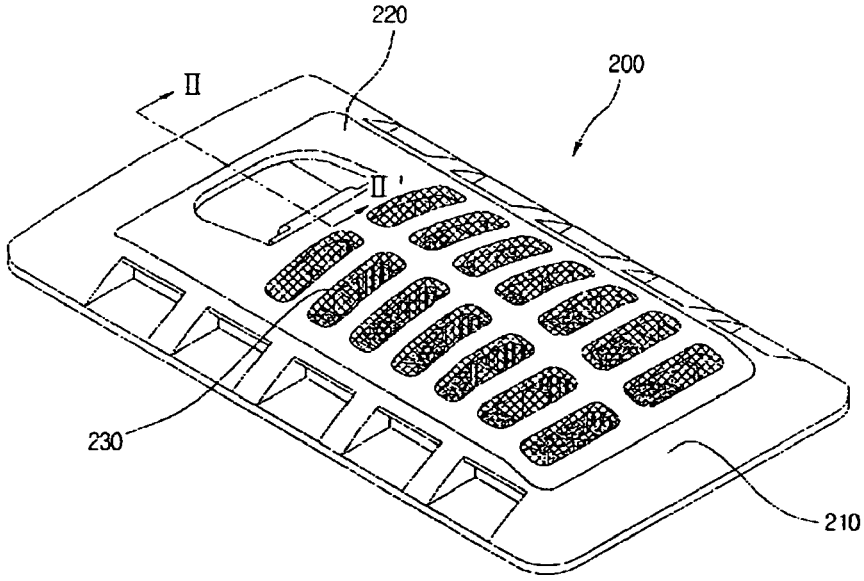

[Fig. 3]
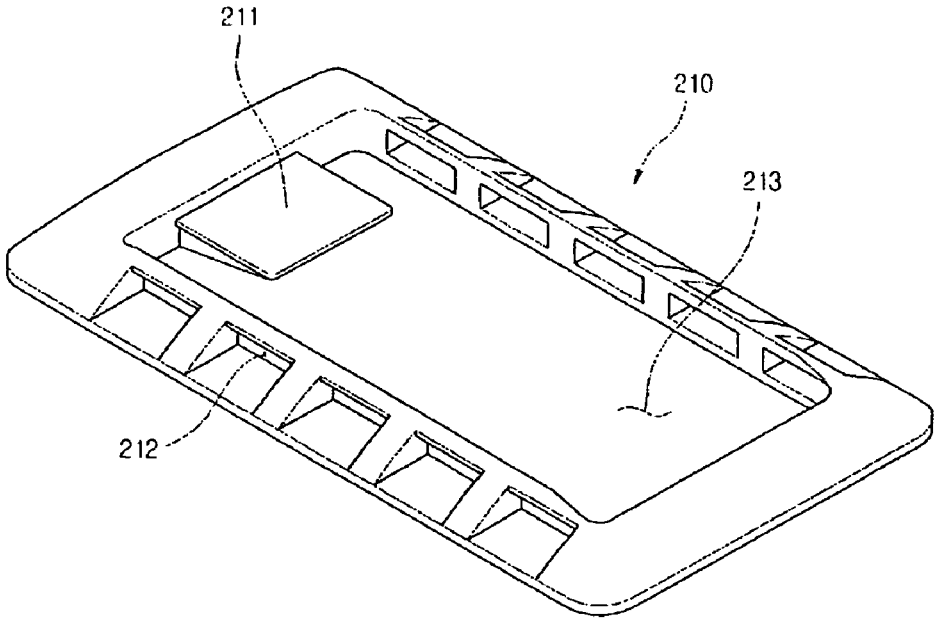
[Fig. 4]
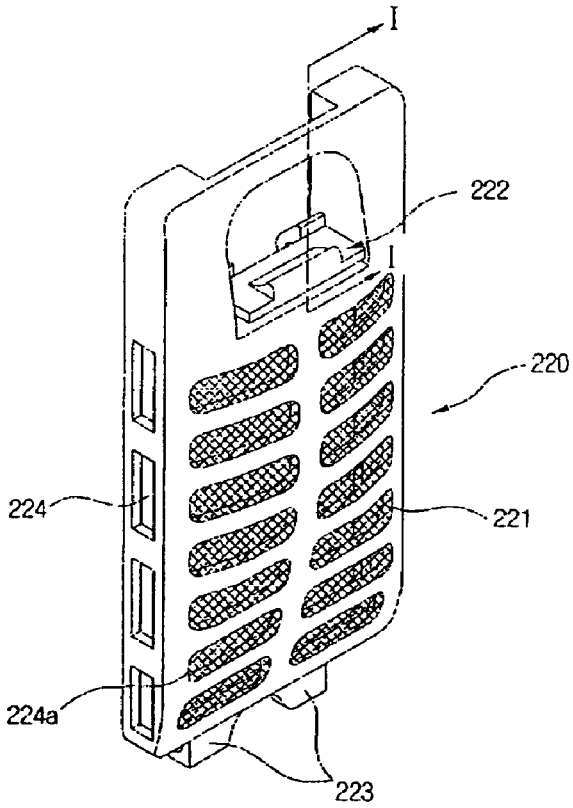

[Fig. 5]
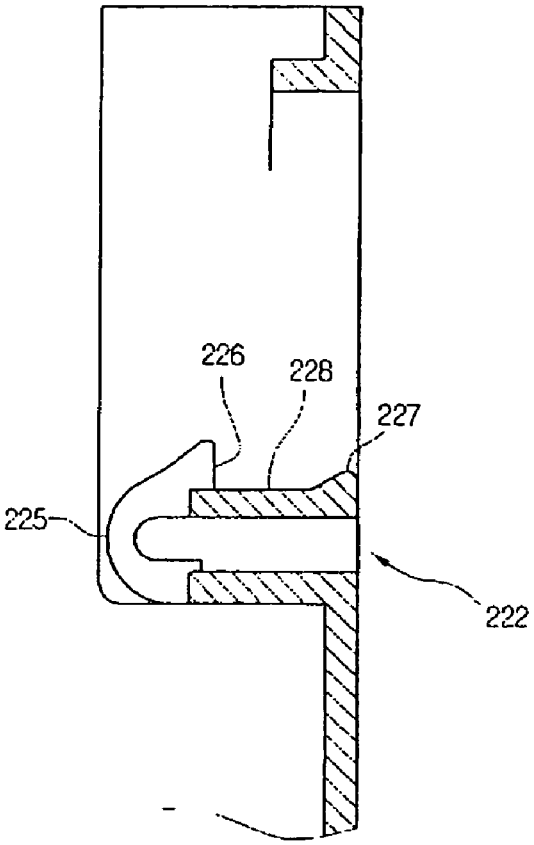
[Fig. 6]
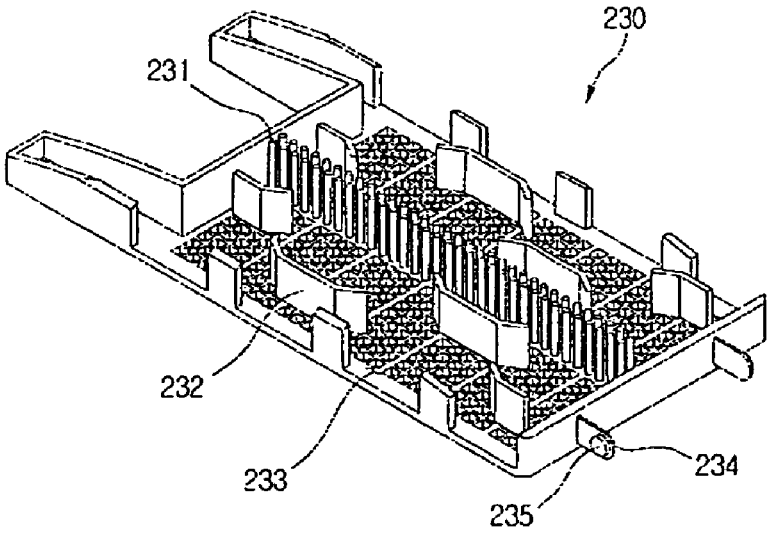

[Fig. 7]
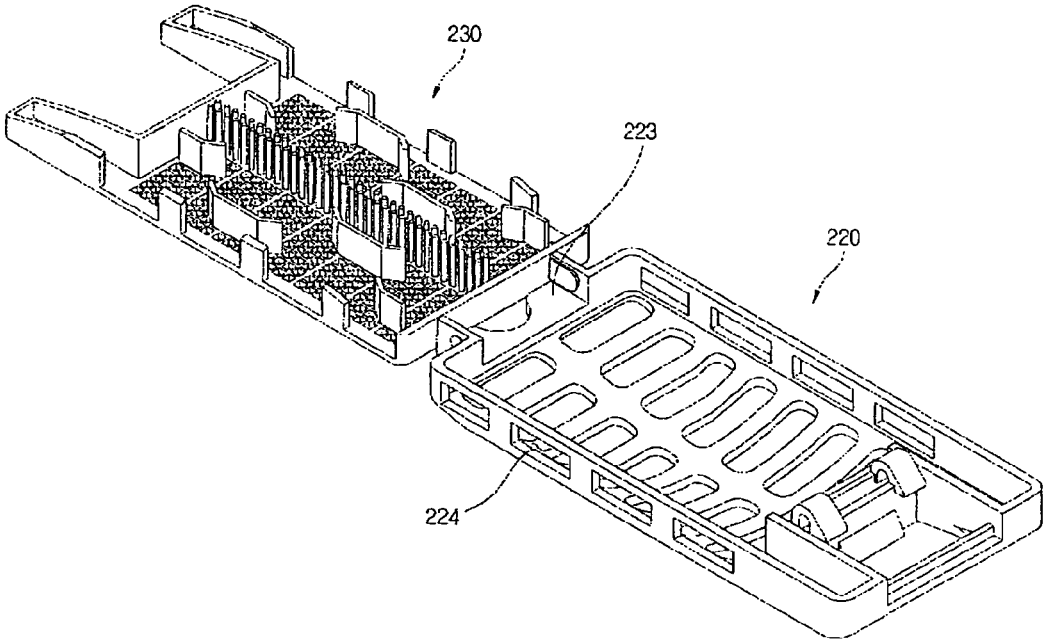
[Fig. 8]
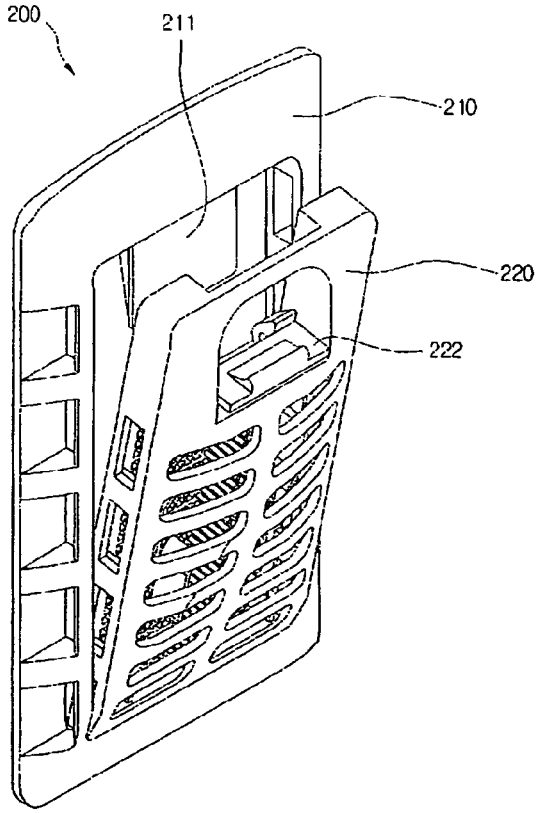

[Fig. 9]
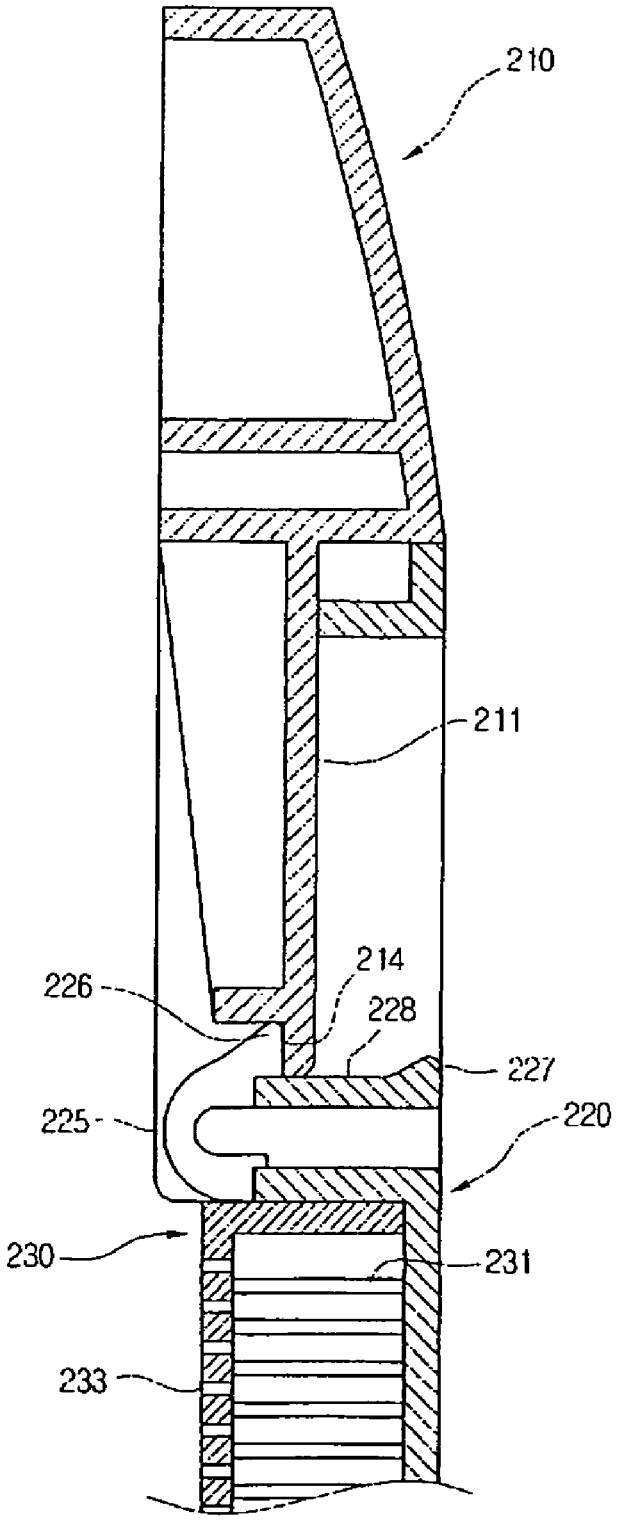

[Fig. 10]
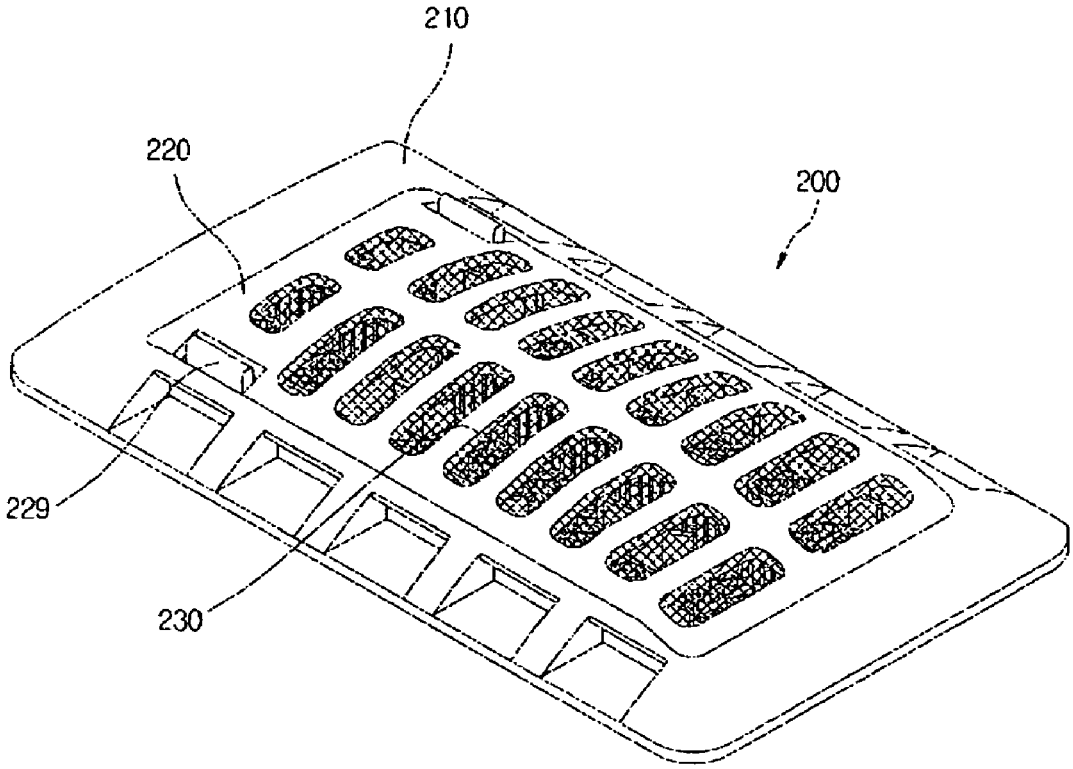

LAUNDRY MACHINE AND LINT FILTER THEREOF

BACKGROUND OF THE INVENTION

1. Technical Field

The present invention relates to a laundry machine, and more particularly, to a lint filter of a laundry machine, which is capable of effectively removing lint and foreign substances from washing water that circulates in a tub.

2. Related Art

Laundry machines are home appliances for automatically washing clothes, bed linen, and other articles. In a pulsator type laundry machine, a pulsator is rotated to whirl clothes together with water containing detergent to remove dirt from the clothes. That is, the clothes are cleaned by the chemical action of the detergent and the mechanical actions of the water and the pulsator.

A pulsator type laundry machine includes an enclosing case, an outer tub accommodated in the case, an inner tub rotatably installed in the outer tub for washing and spin-drying operations, and a pulsator formed at a bottom of the inner tub.

The pulsator and the inner tub are rotated by a driving motor installed under the inner tub. During a washing operation, both the pulsator and the inner tub are rotated, and during a spin-drying operation the inner tub is only rotated.

Also, the pulsator type laundry machine includes a lint filter to remove lint and other foreign substances that are separated from clothes.

Examples of such lint filters are disclosed in Korean Patent Application Nos. 2001-0073573 and 2002-0045381.

In operation, the driving motor is operated to rotate the pulsator to whirl water. The water as it whirls moves away from the pulsator toward the inner tub by a centrifugal force, and it passes through the inner tub to move up along a passage defined between the inner tub and the outer tub. The moved-up water returns to the inner tub after passing through the lint filter where lint and other foreign substances are removed from the water.

However, to pull up the water along the passage between the inner and outer tubs to pass the water through the lint filter, the water must be filled to a specific level and the pulsator must be fully actuated to produce a sufficient centrifugal force to move up the water. Also, the lint filter removes lint and foreign substances only from the move-up water, such that the lint and foreign substances cannot be completely removed.

SUMMARY OF THE INVENTION

Accordingly, the present invention is directed to a lint filter of a laundry machine that substantially obviates one or more of the problems due to limitations and disadvantages of the related art.

An object of the present invention is to provide a lint filter of a laundry machine, which is designed to utilize the flow of washing water in an inner tub and improve wafer passage in the lint filter to easily remove lint and foreign substances from the washing water.

Another object of the present invention is to provide a lint filter of a laundry machine, which is capable of removing lint and foreign substances from washing water even when the amount of the washing water is small or the washing water is not strongly whirled.

To achieve these and other advantages and in accordance with the purpose of the present invention, as embodied and broadly described, there is provided a lint filter of a laundry machine, including: a case; a front filter installed in the case and including a hook formed at least one side; and a rear filter mounted on a back of the front filter.

According to another aspect of the present invention, there is provided a lint filter of a laundry machine, including: a case; a front filter detachably installed in the case and including a water inlet at a side and a water outlet at a front; and a rear filter rotatably mounted on a back of the front filter and including a water inlet at a side.

According to a further another aspect of the present invention, there is provided a laundry machine, including: an inner tub to receive clothes; a lint filter including a case fixedly mounted on an inner surface of the inner tub, a front filter detachably installed into the case, and a rear filter detachably mounted on a back of the front filter; and an outer tub to accommodate the inner tub.

According to the present invention, the lint filter of the laundry is designed to effectively remove lint and foreign substances from the washing water.

Further, collected lint is prevented from going back to the inner tub by the flow of the washing water.

Furthermore, since the lint filter is installed in the inner tub, the washing water can pass through the lint filter directly from the inner tub, instead of moving up along a passage defined between the inner tub and the outer tub to pass through the lint filter. Therefore, the manufacturing process of the laundry machine can be simplified. Also, the manufacturing cost of the laundry machine can be reduced.

DESCRIPTION OF DRAWINGS

FIG. 1 is a phantom view of a pulsator type laundry machine equipped with a lint filter according to the present invention.

FIG. 2 is a perspective view of a lint filter according to the present invention.

FIG. 3 is a perspective view of a case of a lint filter according to the present invention.

FIG. 4 is a perspective view of a front filter of a lint filter according to the present invention.

FIG. 5 is a sectional view taken along line I-I' in FIG. 4.

FIG. 6 is a front perspective view of a rear filter of a lint filter according to the present invention.

FIG. 7 is a perspective view showing a coupling of a front filter and a rear filter according to the present invention.

FIG. 8 is a perspective view showing an installation of a front filter into a case according to the present invention.

FIG. 9 is a sectional view taken along line II-II' in FIG. 2.

FIG. 10 is a perspective view of a lint filter according to another embodiment of the present invention.

DETAILED DESCRIPTION

Hereinafter, preferred embodiments of the present invention will be described in detail with reference to accompanying drawings.

FIG. 1 is a phantom view of a pulsator type laundry machine equipped with a lint filter according to the present invention.

Referring to FIG. 1, a laundry machine 100 includes an enclosing cabinet 110, a top cover 150 installed on the cabinet 110, and a lid 120 installed on the top cover 150 to open and close the laundry machine 100. The top cover 150 includes a control panel 130 at a predetermined portion to control the operation of the laundry machine 100 and a detergent dispenser 151 inserted into an included inner wall.

Further, the laundry machine 100 includes an outer tub 160 accommodated in the cabinet 110, an inner tub 140 rotatably installed in the outer tub 160 to rotate clothes, and a lint filter 200 installed at an inner wall of the inner tub 140 to remove lint from a washing water. The inner tub 140 includes a pulsator 141 at a bottom to whirl the washing water. The term "lint" is used herein to refer to lint, dust, and other foreign substances.

An operation of the laundry machine 100 will now be described.

First, a user loads clothes in the inner tub 140, presses a power button of the control panel 130, selects operating conditions through the control panel 130, and presses a start button to start a washing operation. Upon the pressing of the start button, water is supplied to the inner tub 140 through the detergent dispenser 151 until the inner tub 140 is filled with the water mixed with the detergent (washing water) to a predetermine level. When the washing water is fully filled, the pulsator 141 is rotated.

By the rotation of the pulsator 141, the washing water is whirled together with the clothes and a centrifugal force is generated to move the washing water toward the inner wall of the inner tub 140. That is, the washing water as it whirls moves toward the inner wall of the inner tub 140. The pulsator 141 and the inner tub 140 are reversely rotated at set intervals to agitate the washing water. During these whirling and agitating motions of the washing water, the lint filter 200 removes lint from the washing water by passing it therethrough.

FIG. 2 is a perspective view of the lint filter 200 depicted in FIG. 1.

Referring to FIG. 2, the lint filter 200 has a rectangular shape. Though a rectangular lint filter is illustrated, the shape of the lint filter is not limited to the illustrated shaped.

The lint filter 200 includes a case 210 defining a plurality of water inlets at both sides, a front filter 220 detachably installed in the case 210, and a rear filter 230 detachably or rotatably mounted on a back of the front filter 220.

When assembled, the lint filter 200 is mounted on an inner wall of the inner tub 140 to receive washing water through the water inlets of the case 210 and remove lint from the washing water. To mount the lint filter 200 on the inner tub 140, the case 210 of the lint filter 200 is fixed to the inner wall of the inner tub 140. Since the front filter 220 and the rear filter 230 are detachably installed into the case 210, and the rear filter 230 is detachably or rotatably mounted on the back of the front filter 220, such that a user can easily remove build-up of the collected lint from the lint filter 200 by detaching the front filter 220 and the rear filter 230 from the mounted lint filter 200.

Detail descriptions for the lint filter 200 will now be made with reference to the accompanying drawings.

FIG. 3 is a perspective view of the case 210 of the lint filter 200 depicted in FIG. 2.

Referring to FIG. 3, the case 210 forms the outside of the lint filter 200.

The case 210 includes at least one water inlet 212 at each side, a filter receiving opening 213 at a center with a predetermined length and width, and a coupling tab 211 projected downward from an upper edge of the filter receiving opening 213 with a predetermined length and width. Also, a stepped portion (refer to 214 in FIG. 9) is formed at a back of the coupling tab 211.

The water inlet 212 allows washing water to flow into the front filter 220 and the rear filter 230. After the washing water passes through the front filter 220 and the rear filter 230, lint removed from the washing water is collected at a gap defined between the front filter 220 and the rear filter 230.

The location of the water inlet 212 is selected according to the flow of the washing water.

That is, since the washing water flows mainly along the inner wall of the inner tub 140 about a vertical axis by the rotation of the pulsator 141, the water inlet 212 is formed at each side of the case 210 to easily introduce the washing water into the lint filter 200.

FIG. 4 is a perspective view of the front filter 220 of the lint filter 200 depicted in FIG. 2, and FIG. 5 is a sectional view taken along line I-I' in FIG. 4.

Referring to FIGS. 4 and 5, the front filter 220 is inserted in the filter receiving opening 213 of the case 210 when assembled.

The front filter 220 includes water outlets 224*a* at a front with a predetermined size, a mesh 221 attached at a back to remove lint from washing water before the washing water flows back to the inner tub 140 through the water outlets 224*a*, and at least one water inlet 224 at each side for communicating with the water inlet 212 formed at each side of the case 210.

Further, the front filter 220 includes a coupling rib 223 and a hook 222. The coupling nib 223 is projected downwardly from a bottom of the front filter 220 for coupling with the rear filter 230, and the hook 222 is formed at an upper portion of the front filter 220 to for coupling with the coupling tab 211 of the case 210. The hook 222 includes curved elastic portions. The curved portions move down to receive the coupling tab 211 of the case 210 and move up to lock the coupling tab 211, such that the front filter 220 and the case 210 can be securely coupled.

In detail, the hook 222 includes elastic portions 225, stoppers 226, a push portion 228, and a protrusion 227. The elastic portion 225 has a curved portion to easily receive the coupling tab 211, and the stoppers 226 are formed at ends of the elastic portion 225 to lock the coupling tab 211. The push portion 228 is extended from the stoppers 226 with a predetermined width and length, and the protrusion 227 is formed at an edge of the push portion 228, such that a user can easily separate the front filter 220 from the case 210 by pushing the push portion 228 and pulling out the front filter 220 by the protrusion 227.

When the front filter 220 is inserted into the case 210, the elastic portions 225 are depressed by the coupling tab 211. Since each of the elastic portions 225 has the curved portion, the coupling tab 211 can easily depress the elastic portions 225.

The push portion 228 of the hook 222 is also bent downward when the elastic portions 225 are depressed and it returns to its original position when the coupling tab 211 is fully inserted such that the stoppers 226 can lock the coupling tab 211. The coupling between the case 210 and the front filter 220 can be securely maintained by the stoppers 226. That is, the coupling tab 211 of the case 210 does not released from the hook 222 until the push portion 228 is depressed and pulled out by a user.

The coupling rib 223 of the front filter 220 will be described below together with the rear filter 230.

FIG. 6 is a front perspective view of the rear filter 230 of the lint filter 200 depicted in FIG. 2.

Referring to FIG. 6, when assembled, the rear filter 230 is rotatably coupled to the front filter 220.

The rear filter 230 may be injection molded to have a number of densely spaced depressions or fine holes at its bottom as shown in FIG. 6. The rear filter 230 includes lint collecting bosses 231 projected from a bottom, deceleration ribs 232 at both sides, water inlets 233 at both side edges, and support ribs 234 projected downward from a lower edge for coupling with the front filter 220. Each of the support ribs 234 includes a coupling protrusion 235 at an outer side.

The lint collecting bosses 231 removes lint from washing water that is introduced through the water inlets 233. The deceleration ribs 232 are formed to face the water inlets 233 at predetermined distances to decelerate the washing water flowing into the rear filter 230 through the water inlets 233 to prevent the collected lint from being discharged out of the rear filter 230 by the washing water.

FIG. 7 is a perspective view showing a coupling of the front filter 220 and the rear filter 230 according to the present invention.

Referring to-FIG. 7, the coupling protrusions 235 of the rear filter 230 are inserted into the coupling rib 223 of the front filter 220. The coupling rib 223 defines holes to receive the coupling protrusions 235. By rotating the rear filter 230 toward the front filter 220 about the coupling protrusions 235, the rear filter 230 can be inserted into the back of the front filter 220.

FIG. 8 is a perspective view showing an installation of the front filter 220 into the case 210 according to the present invention, and FIG. 9 is a sectional view taken along line II-II' in FIG. 2.

The coupling between the front filter 220 and the case 210 will now be described with reference to FIGS. 8 and 9.

First, the rear filter 230 is mounted on the back of the front filter 220 as described above with reference to FIG. 7. Next, the coupling rib 223 of the front filter 220 is inserted into a rib insertion hole (not shown) defined in a lower portion of the case 210, and the front filter 220 is rotated into the case 210 from the front of the case 210. When the elastic portions 225 of the hook 222 makes contact with the coupling tab 211 of the case 210, the lint filter 200 is further rotated to move down the elastic portions 225 by the coupling tab 211. After going over the elastic portions 225, the coupling tab 211 is hooked by the stoppers 226. That is, the stoppers 226 make contact with a stepped portion 214 formed at a lower back of the coupling tab 211 to securely lock the front filter 220.

The front filter 220 can be detached by depressing and pulling out the push portion 228. Since the protrusion 227 is formed at an end of the push portion 228, the push portion 228 can be easily pulled out.

That is, a user can release the coupling tab 211 from the stoppers 226 by depressing the push portion 228 and then he/she can separate the hook 222 from the coupling tab 211 by pulling out the push portion 228 while depressing it.

When the front filter 220 is rotated out from the case 210 by the pulling of the push portion 228, the user can completely detach the front filter 220 from the case 210 by lifting up the front filter 220. Then, the user can separate the rear filter 230 from the front filter 220 to remove collected lint from the front filter 220 and the rear filter 230.

As described above, the lint filter 200 is mounted on an inner face of the inner tub 140 to receive washing water through the water inlets 212 formed at both sides and discharge the washing water through the water outlets 224*a* formed at a front after passing the washing water through the front filter 220 and the rear filter 230 to remove lint from the washing water.

Therefore, it is not required to move up the washing water along between the outer tub 160 and the inner tub 140 to pass the washing water through a lint filter. Also, the lint collecting bosses 231 prevent the lint collected in the lint filter 200 from going back to the inner tub 140.

FIG. 10 is a perspective view of a lint filter according to another embodiment of the present invention.

Referring to FIG. 10, a lint filter 200 includes a case 210, a front filter 220, and hooks 229. The lint filter 200 is characterized by the hooks 229 that are formed at both sides to couple the front filter 220 with the case 210.

In detail, the hooks 229 are formed at both sides of the front filter 220, such that the front filter 220 can be more easily detached from the case 210 by using the hooks 229 than using a single hoot Also, the front filter 220 can be more securely attached and detached to and from the case 210.

To install the front filter 220 in the case 210, a coupling rib 223 of the front filter 220 is inserted into a lower edge of the case 210, and then the front filter 220 is rotated into case 210 to snap the front filter 200 into the case 210. For example, after inserting the coupling rib 223 into the lower edge of the case 210, a user can hold the front filter 220 by the hooks 229 and push it into the case 210. After the front filter 220 is fully inserted, the user releases the hooks 229 to lock the front filter 220 in the case 210.

The front filter 220 can be removed from the case 210 by carrying out the installation procedures in the reverse order.

Since the hooks 229 are formed at both sides of the front filter 220, problems encountered when a single hook is formed can be reduced. For example, build-up of lint on the protrusion 227 and hooking of clothes on the protrusion 227 can be prevented.

Further, since the hooks 229 are formed at both sides of the front filter 220, the effective area of the lint filter 200 can be increased. That is, the front filter 220 does not require a portion for coupling with the coupling tab 21 of the case 210, such that the front filter 220 can be formed with more lint collecting pins 231, deceleration ribs 232, and water inlets 233.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

According to the present invention, since the lint filter is mounted on the inner face of the inner tub to receive the washing water from the inner tub and discharge the washing water back to the inner tub after removing lint from the washing water, the water passage between the inner tub and the outer tub is not required to pass the washing water through the lint filter. Therefore, the lint filter can be applied to various fields because it does not require the complicated water passage between the inner tub and the outer tub.

The invention claimed is:

1. A lint filter of a laundry machine, comprising:

a case that couples to an inner tub of the laundry machine; and a filtering assembly detachably mounted to the case, wherein the filtering assembly includes:

a front filter detachably coupled to the case and including a hook formed at least one side of the front filter; and a rear filter mounted on a back of the front filter, wherein the rear filter includes:

a plurality of lint collecting bosses that protrudes from an inner surface thereof and collects lint;

at least one deceleration rib that extends from an inner surface thereof and decelerates washing water introduced into the lint filter; and a plurality of densely spaced holes that passes washing water therethrough, wherein the case includes a first side inlet and a second side inlet that is opposite to the first side inlet, wherein the front filter includes a third side inlet that corresponds to the first side inlet of the case and a fourth side inlet that corresponds to the second side inlet of the case, wherein the plurality of lint collecting bosses is disposed between the third and fourth side inlets of the front filter, and wherein the at least one deceleration rib is disposed between the plurality of lint collecting bosses and at least one of the third or fourth side inlets.

2. The lint filter according to claim 1, wherein the case includes a filter receiving opening at a center that receives the front filter.

3. The lint filter according to claim 1, wherein the rear filter is rotatably mounted on the back of the front filter.

4. The lint filter according to claim 1, wherein the rear filter is detachable from the front filter.

5. The lint filter according to claim 1, wherein the front filter includes at least one coupling rib that extends from a lower end of the front filter at a predetermined length.

6. The lint filter according to claim 1, wherein the rear filter includes:

at least one support rib that extends from a lower end of the rear filter with a predetermined length and couples with the front filter; and a coupling protrusion that projects from the at least one support rib.

7. The lint filter according to claim 1, wherein the case includes a coupling tab that extends from an upper portion of the case with a predetermined length, and couples with the hook of the front filter.

8. The lint filter according to claim 7, wherein the coupling tab is formed with a stepped portion at a rear end that makes a tight contact with the hook of the front filter.

9. The lint filter according to claim 1, wherein the hook includes:

a push portion configured to receive a force applied by a user;

a protrusion projected from a top end of the push portion; and an elastic portion formed integral with an end of the push portion, wherein the elastic portion has a curved shape.

10. The lint filter according to claim 1, wherein the hook is formed at an upper side of the front filter or at each side of the front filter.

11. The lint filter according to claim 1, wherein the at least one deceleration rib includes a plurality of first ribs disposed between the third side inlet and the plurality of lint collecting bosses, and a plurality of second ribs disposed between the fourth side inlet and the plurality of lint collecting bosses.

12. A laundry machine comprising the lint filter of claim 1.

* * * * *